US008347955B1

(12) United States Patent
Sewell et al.

(10) Patent No.: US 8,347,955 B1
(45) Date of Patent: Jan. 8, 2013

(54) PLUNGER LIFT MECHANISM

(75) Inventors: Michael Sewell, Keene, TX (US); Amy C. Stephens, Hudson Oaks, TX (US)

(73) Assignee: 4S Oilfield Technologies, LLC, Fort Worth, TX (US)

( * ) Notice: Subject to any disclaimer, the term of this patent is extended or adjusted under 35 U.S.C. 154(b) by 298 days.

(21) Appl. No.: 12/701,369

(22) Filed: Feb. 5, 2010

Related U.S. Application Data

(60) Provisional application No. 61/229,173, filed on Jul. 28, 2009.

(51) Int. Cl.
*E21B 43/00* (2006.01)

(52) U.S. Cl. ..... 166/105; 166/68; 166/372

(58) Field of Classification Search ..... 166/372, 166/105, 68; 417/56
See application file for complete search history.

(56) References Cited

U.S. PATENT DOCUMENTS

| | | | | |
|---|---|---|---|---|
| 2,676,547 | A * | 4/1954 | Knox | 417/60 |
| 3,473,611 | A * | 10/1969 | Gregston | 166/310 |
| 6,176,309 | B1 * | 1/2001 | Bender | 166/68 |
| 6,554,580 | B1 * | 4/2003 | Mayfield et al. | 417/56 |
| 6,688,385 | B1 * | 2/2004 | Moe | 166/53 |
| 6,755,628 | B1 * | 6/2004 | Howell | 417/448 |
| 7,188,670 | B2 * | 3/2007 | Amies et al. | 166/105 |
| 7,290,602 | B2 * | 11/2007 | Victor | 166/105 |
| 7,328,748 | B2 * | 2/2008 | Giacomino | 166/369 |
| 7,383,878 | B1 | 6/2008 | Victor | |
| 7,513,301 | B2 * | 4/2009 | Victor | 166/105 |
| 2007/0151738 | A1 * | 7/2007 | Giacomino | 166/372 |
| 2007/0246211 | A1 * | 10/2007 | Schneider et al. | 166/105 |
| 2009/0188673 | A1 * | 7/2009 | Hearn et al. | 166/372 |

* cited by examiner

*Primary Examiner* — Giovanna Wright
*Assistant Examiner* — Michael Wills, III
(74) *Attorney, Agent, or Firm* — Hall Estill Attorneys at Law; Daniel P. Dooley

(57) ABSTRACT

Method and apparatus for a plunger lift mechanism with a main channel disposed between a first and second valve. The first valve is closed by engaging a sealing member to a first seat at a proximal end of the main channel and the second valve consequently closes to with a sealing member engaging a second seat at a distal end of the main channel. An amount of pressure accumulates on a first side of the plunger lift to overcome a pressure on a second side of the plunger lift to force the plunger lift to traverse a well bore and evacuate any fluids present above the plunger lift.

20 Claims, 6 Drawing Sheets

PLUNGER LIFT MECHANISM

RELATED APPLICATIONS

This application claims priority to U.S. Provisional Application No. 61/229,173 filed Jul. 28, 2009, entitled "Plunger Lift Mechanism."

FIELD OF THE INVENTION

The claimed invention relates to the field of downhole well equipment and operations and more particularly to clearing liquids from a downhole low pressure environment.

BACKGROUND

The accumulation of fluids in natural gas well casings, i.e., flowback, restricts the flow by exerting high pressure on the face of the producing formation. One relatively inexpensive method for removing such accumulations of fluids is the use of a plunger lift, which is dropped into the well and then moved upwardly by the formation pressure to lift the liquid in the well casing to the surface. Prior art plunger lifts include a valve held in the closed position by pressure from the produced liquids and gases below the plunger and by a clutch mechanism. These clutch mechanisms wear out over time, and in certain wells, especially those with low pressure or low flow rates, the pressure from the fluid column being lifted can overcome the clutch mechanism, causing the valve to open, sending the plunger and fluid column back to the bottom of the well.

As such, a cyclic mechanism capable of accumulating, retaining, and releasing pressure in an efficient and reliable manner can greatly improve the operation and production of current and future wells.

Accordingly, there is a continuing need for improved mechanisms that transport liquids to the surface of a well bore efficiently and reliably.

SUMMARY OF THE INVENTION

The present disclosure relates to downhole equipment, and in particular to devices and methods that may be used to efficiently maintain operation of drilling operations.

In accordance with various exemplary embodiments, a plunger lift mechanism is provided that has a plunger lift with a main channel disposed between a first and second valve. The first valve of an exemplary embodiment is preferably adjacent a proximal end of the plunger lift, and the second valve is preferably adjacent a distal end of the plunger lift. In an operation of the exemplary embodiment, closing the first valve is achieved by engaging a first sealing member to a first valve seat at a proximal end of the main channel, while operation of the second valve is accomplished by engaging a second valve seat with a second sealing member, in which the second valve seat is adjacent a distal end of the main channel. The second sealing member seats in the valve seat, in response to a pressure impinging upon the distal end of said plunger lift, which loads the second sealing member.

In an operating mode of the exemplary embodiment, the result of accumulating sufficient pressure on the proximal end of the plunger lift, to overcome the pressure on the distal end of said plunger lift, results in forcing the plunger lift to traverse a well bore and evacuate any fluids present above the plunger lift.

These and various other features and advantages that characterize the claimed invention will be apparent upon reading the following detailed description and upon review of the associated drawings.

DETAILED DESCRIPTION OF AN EXEMPLARY EMBODIMENT OF THE DRAWINGS

Reference will now be made in detail to one or more examples of the invention depicted in the figures. Each example is provided by way of explanation of the invention, and not meant as a limitation of the invention. For example, features illustrated or described as part of one embodiment may be used with another embodiment to yield still a different embodiment. Other modifications and variations to the described embodiments are also contemplated within the scope and spirit of the invention.

In operation, the accumulations of fluids in natural gas well casings can restrict the flow by exerting high pressure on the face of a producing formation. One relatively inexpensive method for removing such accumulations of fluids is the use of a plunger lift which includes a piston that is dropped into the well and then moved upwardly to lift the liquid to the surface. Such plunger lifts can include a valve which is held in a closed position by pressure from the produced liquids and gases below the plunger and by means designed within the tool such as a clutch mechanism. However, such plunger lifts and specifically the clutch mechanisms can wear out over time, and in certain wells, especially those with low pressure or low flow rates, the pressure from the fluid column being lifted can cause the valve to be pushed open, sending the plunger and fluid column back to the bottom of the well.

Accordingly, a plunger lift with a valve acting as a check valve to prevent a primary valve from being opened by the pressure of the fluid column being lifted by the plunger lift can provide advantageous operation with improved reliability. The check valve can prevent large amounts of pressure from exerting on opposing sides of a closed primary valve. As such, the primary valve can operate by accumulating pressure below the plunger lift and forcing liquid above the plunger lift to the top of a well bore reliably and without inadvertent openings or failure.

Figure 1:
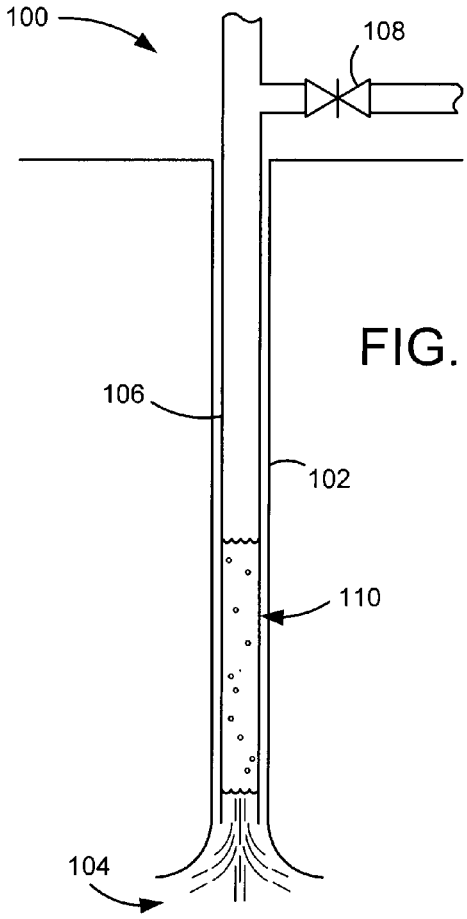
FIG. 1 displays an exemplary environment in which a plunger lift mechanism can be operated.

Turning to the drawings, FIG. 1 displays an exemplary well bore environment 100 which includes at least a well bore 102 that extends from above ground to a geological reservoir 104. Such a reservoir 104 can produce various amounts of liquid and gas that can be controlled by a well bore casing 106 and in some circumstances a control valve 108. During production of the reservoir 104, an amount of liquid can accumulate as a plug 110 that effectively blocks the transmission of gas through the casing 106.

Figure 2:
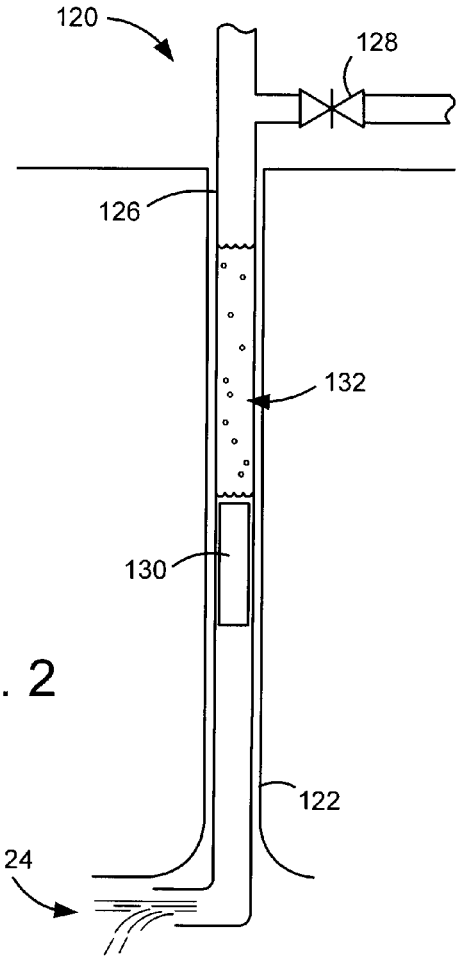
FIG. 2 provides an exemplary operation of the environment of FIG. 1.

FIG. 2 provides an exemplary system 120 to remove unwanted liquid from a well bore 122. As fluid restricts the flow of gas through the well bore casing 126, a control valve 128 can experience a low pressure occurrence. In response, a slug 130 can be used to evacuate a column of liquid 132 from the well bore casing 126. The slug 130 can be configured to allow pressure from the reservoir 124 to build in the casing 126 and consequently propel the slug 130 and liquid 132 through the well bore 122.

In various exemplary configurations, the slug 130 can be designed to continually remain in the well bore casing 126 and cyclically traverse the well bore 122. However, effective operation of the slug 130 requires the presence of a pressure differential between regions above and below the slug 130. Such pressure differential can be generated with a valve that remains closed to build pressure that forces the slug 130 and column of liquid 132 out of the well bore 122.

However, such a valve can deteriorate and fail over time which can result in a halt in production of the well bore 122 and costly recovery operations to remove and repair the slug 130. Furthermore, the slug can fail during proper operation if the column of liquid 132 generates enough pressure on the slug 130 to toggle the valve to an open position that may never close. Indeed, the various difficulties with evacuating liquid can pose time and production restrictions for efficient operation of a well bore.

Figure 3A:
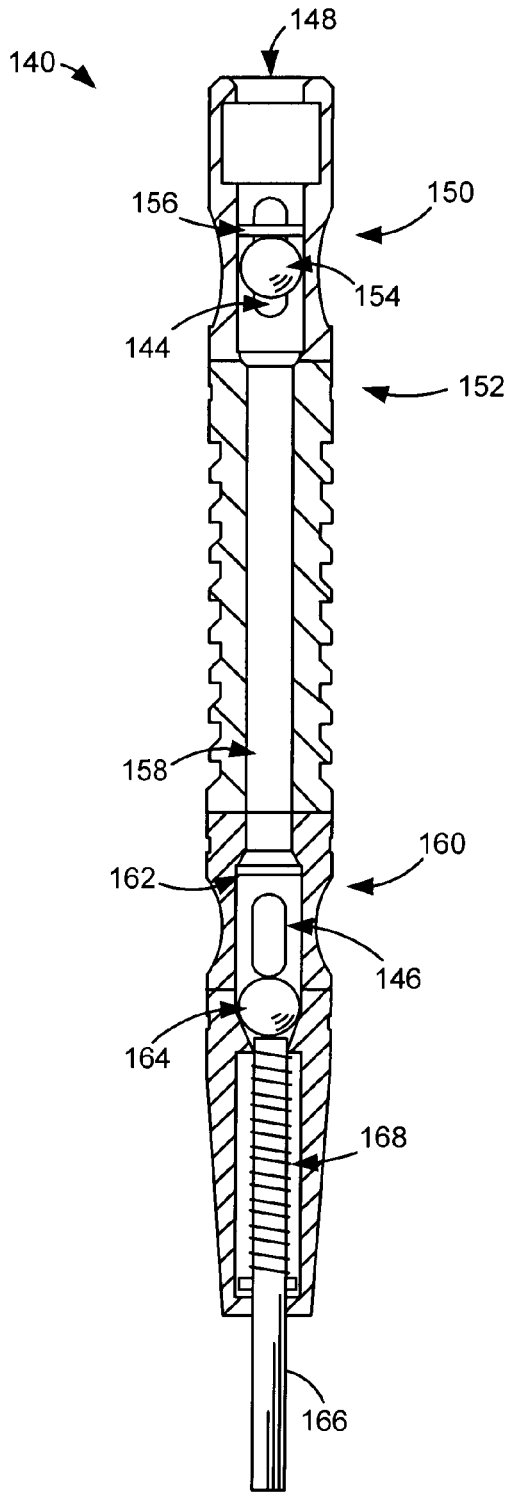
FIGS. 3A-3B show an exemplary plunger lift mechanism constructed and operated in accordance with various embodiments of the present invention.

FIGS. 3A-5B generally illustrate an exemplary plunger lift 140 constructed and operated in accordance with various embodiments of the present invention. FIGS. 3A and 3B show the plunger lift 140 constructed with an elongated body 142 that has at least a first and second port 144 and 146 that can be independently opened or closed during operation. As shown, the plunger lift 140 is in an operational position as if traveling down a well bore. To allow a decent through the well bore, the first and second ports 144 and 146 are open to allow fluidic flow through the elongated body 142.

In some embodiments, a third port 148 is provided adjacent a check valve 150 to further allow fluidic flow through the plunger lift 140. The check valve 150 can be constructed with a seat 152 that is engaged by a sealing member 154 to prevent fluidic flow through either the first or third ports. While the check valve 150 is open, the sealing member 154 is restricted from evacuating by a restriction bar 156. Further restriction of the sealing member 154 can be facilitated by the construction of the first port 154 with a smaller dimension than the smallest dimension of the sealing member 154.

While the check valve 150 is open, fluids can flow through the elongated body 142 via the main channel 158, as shown by the cross-sectional view of FIG. 3A, to the primary valve 160. The primary valve 160 can be constructed with a seat 162 and a sealing member 164 so that no fluidic flow can occur through the second port to the main channel 158. In various embodiments, the primary valve 160 is positioned in the elongated body 142 in an opposite orientation to the check valve 150. Such opposing orientation can allow for pressure to be accumulated from below the plunger lift 140 when the primary valve 160 is closed.

The primary valve 160 can be selectively closed through the movement of a pushrod 166 that positions the sealing member 164 into contacting engagement with the seat 162 and effectively prevents fluidic flow from the second port 146 to the main channel 158. In operation, once the primary valve is closed and the sealing member 164 engages the seat 162, the pushrod 166 can freely move away from the sealing member 164 with the aid of a compressive member 168. However, some embodiments of the present invention have the weight of the elongated body 142 causing the pushrod 166 to depress against a surface at the bottom of a well bore. In such an occasion, movement of the pushrod 166 away from the sealing member 164 could not occur until the entire plunger lift 140 is transported upward through the well bore.

It should be noted that the sizes, shapes, and orientations of the various components of the plunger lift 140 are merely exemplary and in no way limit the potential scope of construction or operation. In one such exemplary construction, a portion of the elongated body 142 can be configured with a plurality of ribs 170 that annularly provide turbulence to remove any debris from the sides of the well bore while the plunger lift 140 traverses to the surface. While in It can be appreciated that the various components of the plunger lift 140 can be manufactured and assembled in a variety of manners, none of which are required or limited. Such manufacturing could be any number of processes including, but not limited to, machining, casting, and molding either individually or in combination. Similarly, the materials used to manufacture the plunger lift 100 can be any number of substances including, but not limited to, steel, stainless steel, plastics, fiberglass, and any metal alloy combination of metals.

In the exemplary configuration shown in FIG. 3A, at least three different materials are manufactured into the various components of the plunger lift 140. However, the plunger lift 140 can likewise be constructed out of a single piece of a single material without deterring from the spirit of the present invention.

Figure 4A:
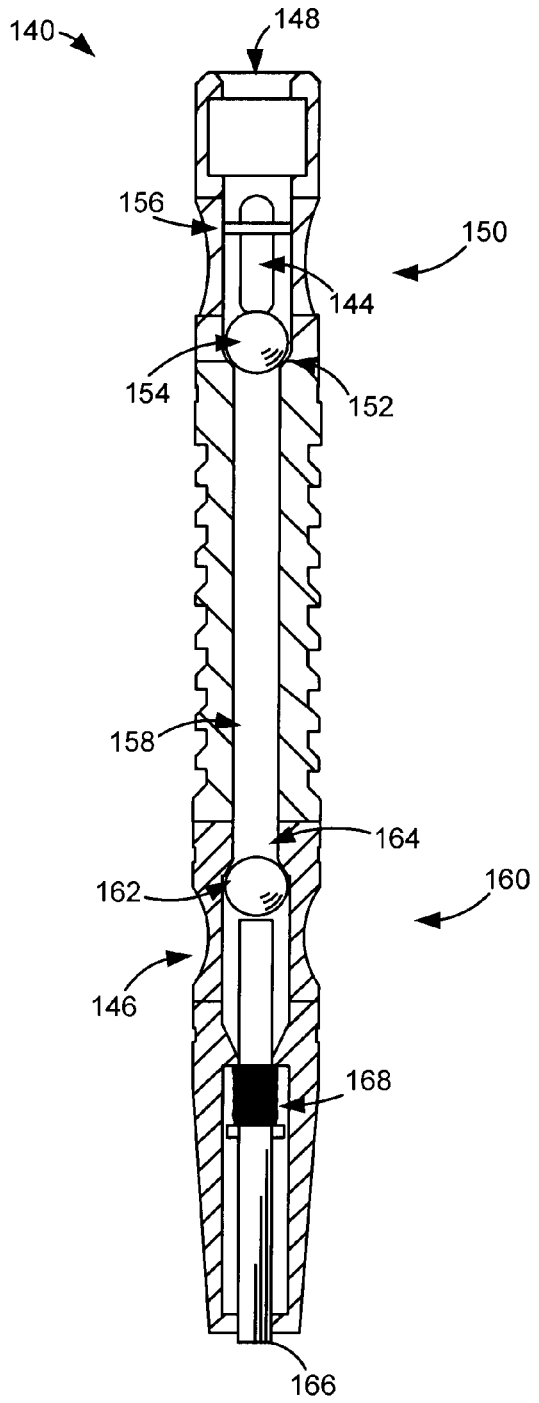
FIGS. 4A-4B illustrate the exemplary plunger lift mechanism of FIGS. 3A and 3B operated in accordance with various embodiments of the present invention.
Figure 4B:
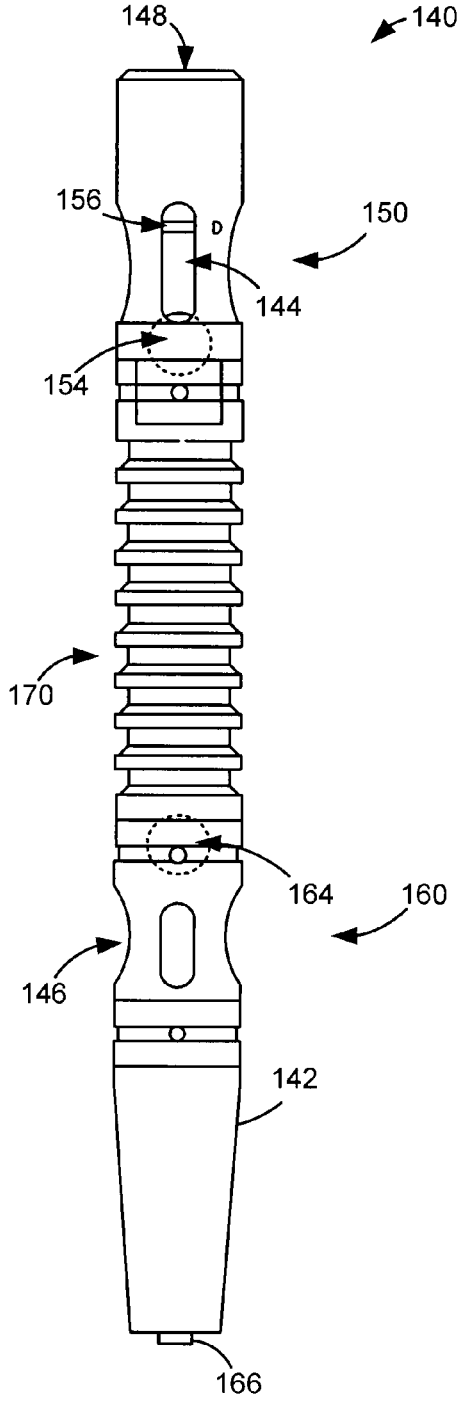

FIGS. 4A and 4B further illustrate the plunger lift 140 in accordance with various embodiments of the present invention. Upon the exertion of pressure from below the plunger lift 140, the sealing member 164 is forced into contacting engagement with the seat 162 that effectively closes the primary valve 160 and prevents fluidic flow through the elongated body. In some embodiments, such closing of the primary valve 160 is facilitated without the pushrod 166. As a result of the lack of fluidic flow through the main channel 158, a low pressure region will be created between the sealing member 154 and the seat 152 of the check valve 150. Consequently with the aid of gravity, the sealing member 154 drops into contactingly engagement with the seat 152 to further prevent fluidic flow through the main channel 158.

As can be appreciated, the timing and function of the primary and check valves 160 and 150 are not limited and can occur in any sequence either selectively or automatically without deterring from the spirit of the present invention. For example, the primary valve 160 could be selectively closed by a controlling operation from the surface either electronically or mechanically. Furthermore, the plunger lift 140 can correspond with multiple other pieces of well bore equipment such as an external valve present at the bottom of a well bore that supplements the accumulation of pressure below the plunger lift 140 or a lubrication region at the top of the well bore that opens the primary valve 160 once predetermined well bore conditions are met.

With the check valve 150 and primary valve 160 closed and no fluidic flow through the plunger lift 140, external pressure will accumulate over time below the primary valve 160. Meanwhile, an external pressure will be exerted on the plunger lift 140 from above by either liquids, solids, or a combination of the two. Subsequently, the accumulated pressure below the plunger lift 140 will overcome the pressure exerted from above and the plunger lift 140 and begin to traverse the length of the well bore while forcing any solids and liquids above the plunger lift 140 to the surface. In various embodiments, the plurality of ribs 170 can be supplemented or replaced by a variety of configurations to aid in the removal of unwanted substances from the well bore.

Figure 5A:
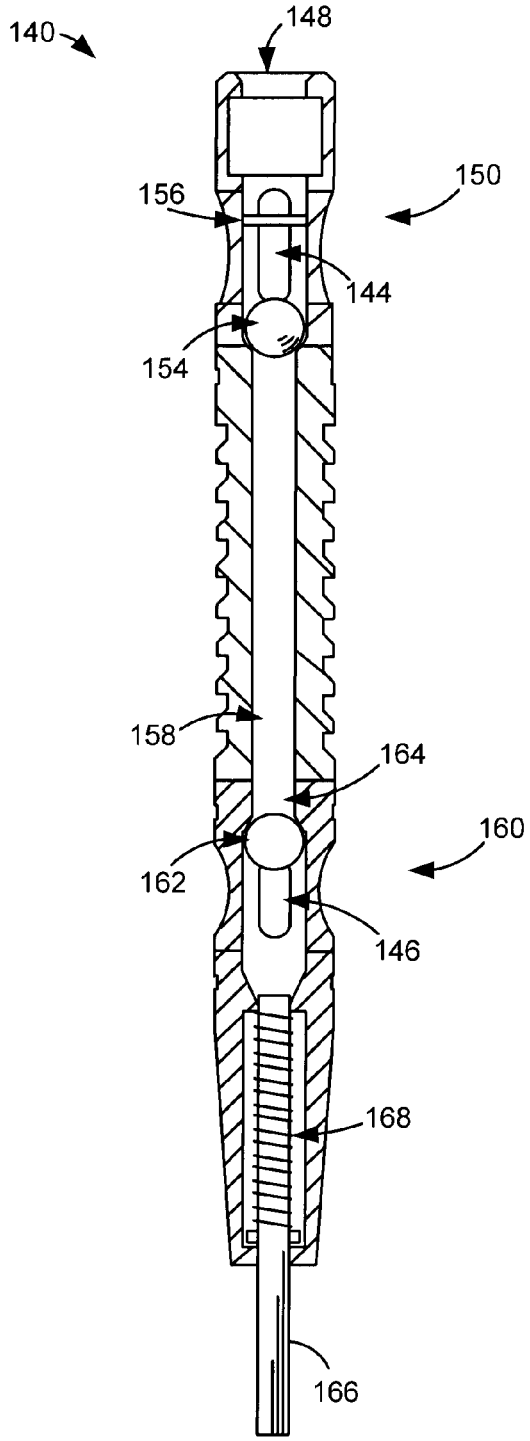
FIGS. 5A-5B provide an exemplary plunger lift mechanism of FIGS. 4A and 4B operated in accordance with various embodiments of the present invention.
Figure 5B:
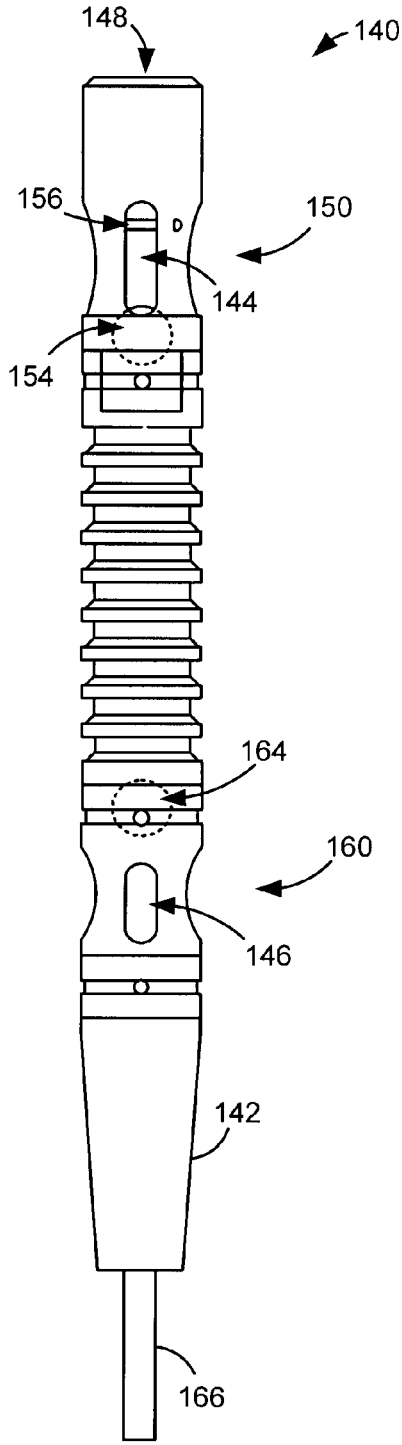

In FIGS. 5A-5B, an exemplary operation of the plunger lift 140 is displayed as it traverses the well bore in the presence of a pressure differential between the regions above and below the plunger lift 140. As shown, both the check and primary valves 150 and 160 remain closed and the sealing members 154 and 164 remain in contacting engagement with the seats 152 and 162, respectively. The closed operational position of the check valve 150 during ascent through the well bore advantageously prevents the primary valve 160 from being inadvertently unseated by the pressure present above the plunger lift 140. As such, the plunger lift 140 can reliably utilize the accumulated pressure below the plunger lift 140 without concern that the sealing member 164 of the primary valve 160 fatigues or fails over time.

In contrast, without the check valve 150, the primary valve 160 and the sealing member 164 would be the only interface between the opposing pressures present above and below the plunger lift 140. As can be appreciated, such configuration in combination with the cyclic operation of the plunger lift 140 would degrade the primary valve 160 over time and greatly increase the potential for an inadvertent opening and consequential shutting in of the well.

Returning to FIGS. 5A and 5B, the pushrod 166 will be extruded from the primary valve 160 and the second port 146 through the release of the compressive force of the compressive member 168. That is, the second port 146 will be open while the primary valve 160 is closed as the plunger lift 140 reaches the top of the well bore.

In some embodiments, the plunger lift 140 occupies a region out of the path of the well bore at the surface which allows the accumulated pressurized fluids to evacuate the well without obstruction. As the pressurized fluids evacuate the well bore, the sealing member 164 of the primary valve 160 will no longer be forced into contacting engagement with the seat 162. As such, the sealing member 164 will drop into contact with the pushrod 166 and allow fluidic flow from the second port 146 through the main channel 158. In addition, fluidic flow will unseat the sealing member 154 from the seat 152 of the check valve 150 and allow fluidic access between the main channel 158 and the first and third ports 144 and 148.

Figure 3B:
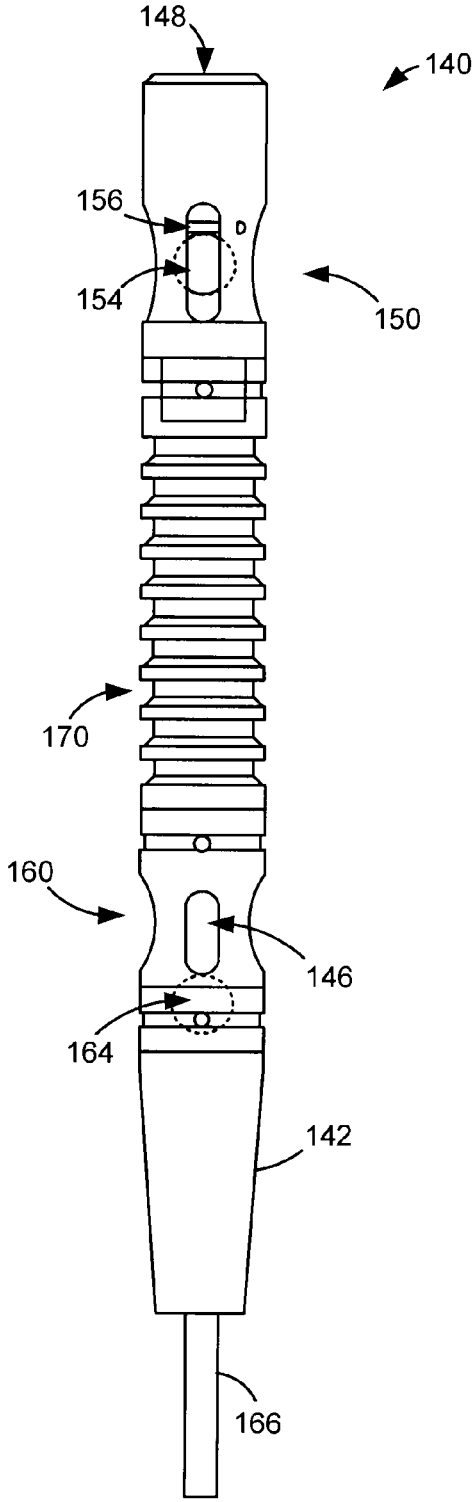

With both valves 150 and 160 open, the plunger lift 140 can fall with the aid of gravity to the bottom of the well bore in a configuration displayed in FIGS. 3A and 3B. As a result, the plunger lift 140 can cyclically accumulate pressure and subsequently evacuate any substances from the well bore while allowing continued operation and production from the well.

It should be noted that in some embodiments, the check and primary valves 150 and 160 are separate pieces such as metal ball bearings which are not constrained to the elongated body 142. While in other embodiments, the elongated body 142 can be configured with an upper housing to provide means for retrieving the tool from the well should it become stuck in the well bore. Such upper housing can further be constructed with a check valve that either replaces or supplements the check valve 150.

In yet another embodiment, the elongated body 142 can be constructed with a lower hosing to contain a secondary valve that can include a valve stem. Such a valve stem could assist the secondary valve to close when the plunger sits on a bumper spring or other such means placed in the well casings to prevent further downward travel of the plunger lift 140. Such embodiment could also include a spring for returning the secondary valve and valve stem to the open position and retaining it in the open position while the plunger lift 140 descends into the well. In addition, the valve stem could be either connected or disconnected from the secondary valve itself.

Figure 6:
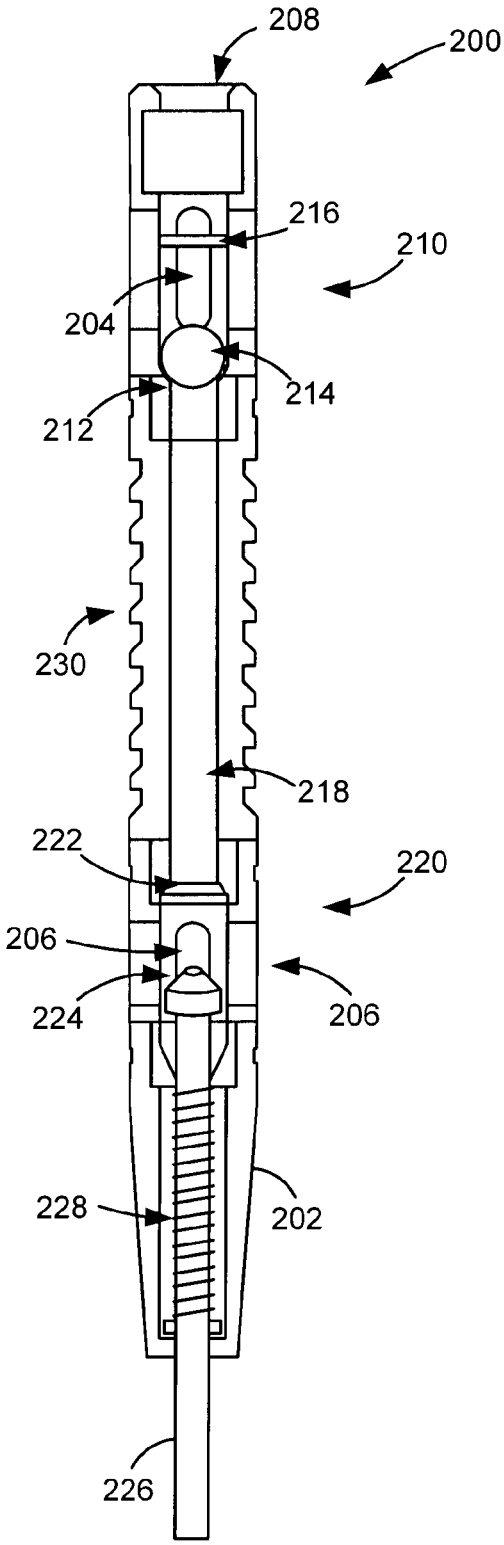
FIG. 6 displays an exemplary plunger lift mechanism constructed and operated in accordance with various embodiments of the present invention.

FIG. 6 generally illustrates another exemplary plunger lift 200 constructed and operated in accordance with various embodiments of the present invention. The plunger lift 200 can be constructed with an elongated body 202 that has at least a first and second port 204 and 206 that can be independently opened or closed during operation. In the operational position shown, the plunger lift 200 can travel down a well bore with fluidic flow through the elongated body 202. Such fluidic flow can be facilitated by opening the first and second ports 204 and 206 to allow fluidic flow.

Similarly to the plunger lift 140, a third port 208 can be constructed at the top of the plunger lift 200. Such third port 208 can be positioned adjacent a check valve 210 to aid in efficient fluidic flow through the plunger lift 200. The check valve 210 can be constructed with a seat 212 that is engaged by a sealing member 214 to prevent fluidic flow through either the first or third ports 204 and 208. While the check valve 210 is open, the sealing member 214 is restricted from evacuating by a restriction bar 216.

While the check valve 210 is open, fluids can flow through the elongated body 202 via a main channel 218 to the primary valve 220. The primary valve 220 can be constructed with a seat 222 and a sealing member 224 so that no fluidic flow can occur through the second port to the main channel 218. However, the sealing member 224 can be connected to a pushrod 226 that extends through the elongated body 202 and has a compressive member 228 acting to maintain the second port 206 open to fluidic flow.

In an exemplary operation similar to that shown in FIGS. 3A-5B, once the primary valve is closed and the sealing member 224 engages the seat 222 and the check valve 210 drops into sealing engagement with the seat 212 to prevent any fluidic flow through the main channel 218. As pressure subsequently builds below the plunger lift 200, the lift will traverse the well bore and consequently evacuate and substances from above the plunger lift 200. As can be appreciated, the plunger will be unseated and allow for the plunger lift 200 to descend the well bore once pressure below the plunger lift 200 reduces to allow the compressive member 228 to open the primary valve 220.

Figure 7:
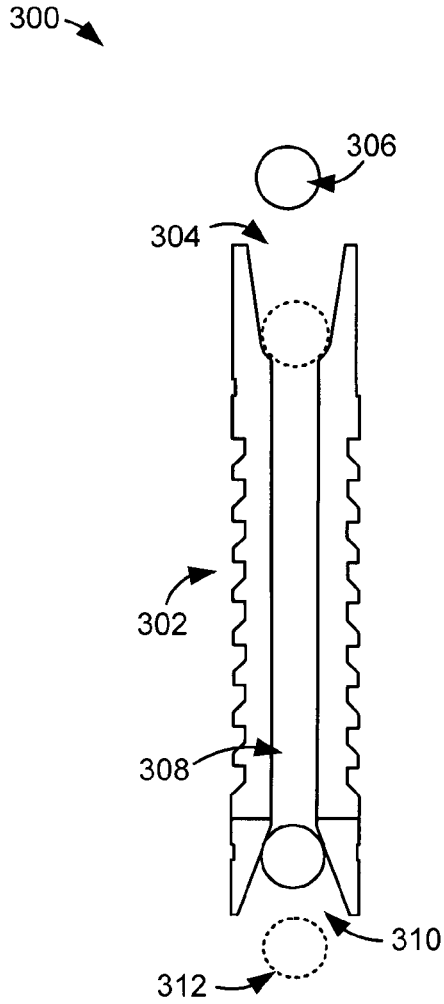
FIG. 7 shows an exemplary portion of the plunger lift mechanism of FIG. 6.

FIG. 7 generally provides a portion of a plunger lift 300 which illustrates an exemplary configuration and operation in accordance with various embodiments of the present invention. As shown, a body portion 302 of a plunger lift has a first valve 304 that is can be engaged by a first sealing member 306 to restrict access through a channel 308 formed in the body portion 302. Additionally, access to the channel 308 can be further restricted through contacting engagement of a second valve 310 with a second sealing member 312.

In some embodiments, the first and second sealing members 306 and 312 can independently engage or disengage the respective valves 304 and 310. That is, the first valve 304 can be open with the first sealing member 306 being disengaged while the second valve 310 is closed through contact with the second sealing member 312. For example, the first and second valves 304 and 310 can repeatedly and respectively seal and unseal the channel 308 independent of the status of the other valve.

Further in an exemplary operation, a plunger lift can be forced down a well bore, such as the well bore of FIGS. 1 and 2, with pressure from above ground that seals the first valve 304 while the second valve 310 remains open. As the plunger lift contacts the bottom of the well bore, the second valve 310 can be forced closed while the remaining pressure in the channel 308 induces the first valve 304 to open and release the pressure above the plunger lift. As such, the independent operation of the valves in the plunger lift can provide a consistent pressure differential between areas above and below the plunger lift.

Figure 8A:
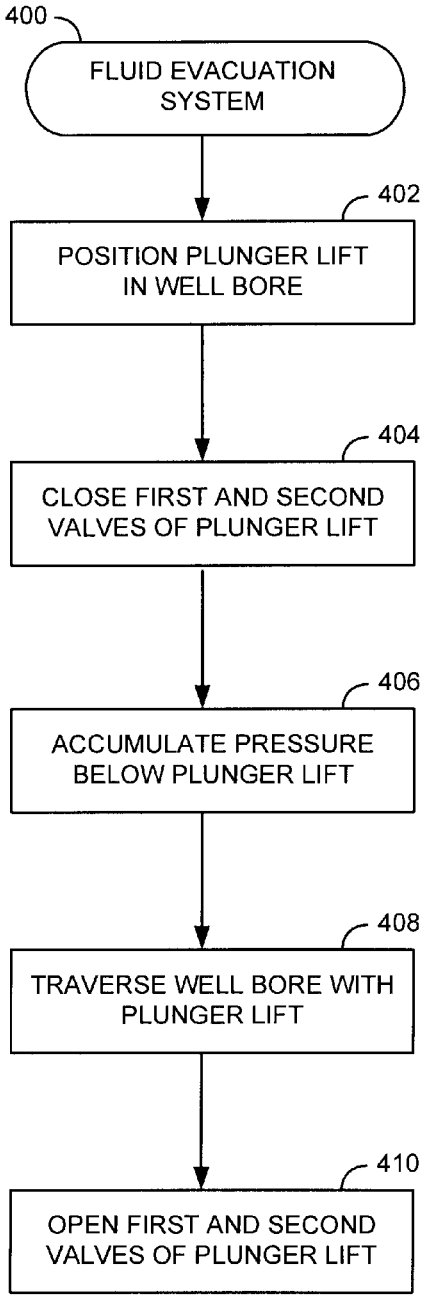
FIGS. 8A and 8B generally illustrate a fluid evacuation routine performed in accordance with various embodiments of the present invention.
Figure 8B:
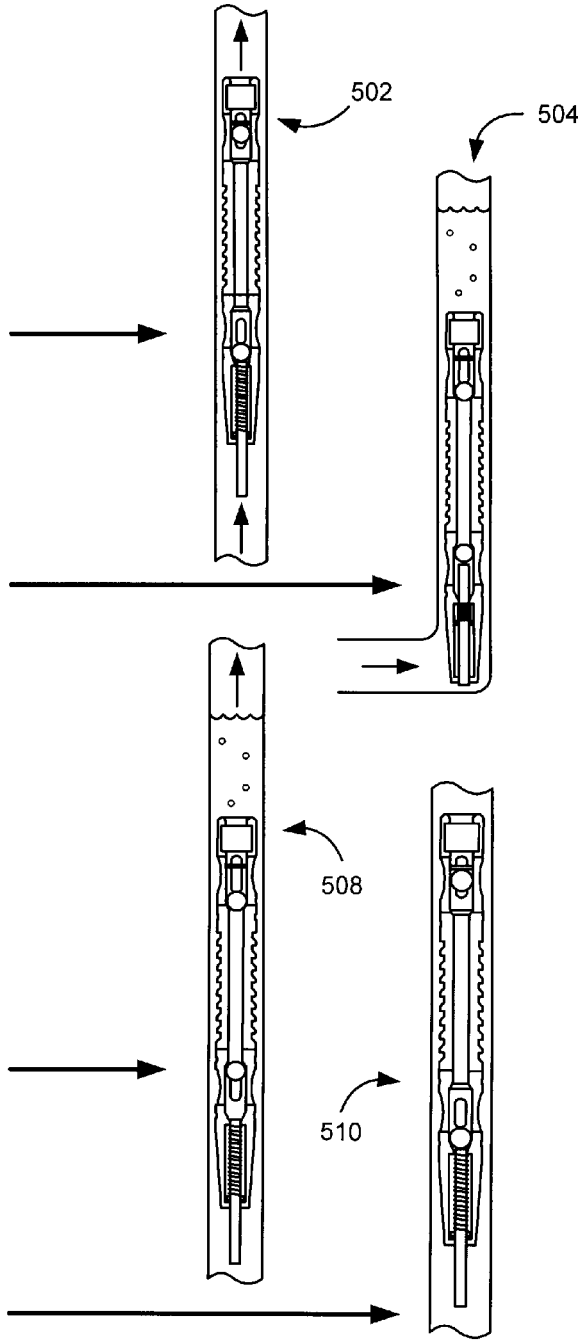

FIGS. 8A and 8B provides an exemplary fluid evacuation routine 400 conducted in accordance with various embodiments of the present invention. The routine 400 initially provides a plunger lift that is positioned in a well bore in step 402, as is generally illustrated in step 502 of FIG. 8B. It should be noted that the plunger lift can be installed in the well bore during any condition and is not limited to initial casing or low pressure occurrences. Step 404 closes the primary and check valves of the plunger lift. While the valves of the plunger lift can close simultaneously, such operation is not required as the valves can selectively operate, as discussed above.

As displayed in step 504, a primary valve is closed upon contact between the plunger lift and the bottom of the well bore casing while the check valve is closed to separate a column of fluid from the well bore reservoir. With the primary valve closed, step 406 accumulates pressure below the plunger lift until the pressure differential between areas above and below the plunger lift is sufficient to induce transmission of the plunger lift through the well bore.

Step 508 of FIG. 8B illustrates that the primary and check valves are closed and the column of liquid above the plunger lift is being evacuated from the well bore. However, the configuration of the plunger lift with valves that open in opposing directions provides additional protection to prevent inadvertent opening of either valve. That is, the pressure from below the plunger lift forces the primary valve closed while the pressure from above the lift similarly forces the check valve closed.

As fluid is evacuated from the well bore, any pressure differential can terminate and the valves can open in step 410 to allow fluid to flow through the plunger lift. The exemplary illustration in step 510 of FIG. 8B displays both valves open, however, one or both of the valves can subsequently close as the plunger lift is redirected down the well bore.

It should be noted that the steps and general illustrations of FIGS. 8A and 8B are merely exemplary and can be modified, deleted, and rearranged with deterring from the spirit of the present invention. For example, step 410 can be omitted altogether or modified so that only one valve of the plunger lift opens after traversing the well bore in step 408. Furthermore, it is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular application without departing from the spirit and scope of the present invention.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims.

What is claimed is:

1. A method comprising the steps of:

providing a plunger lift confined by a casing within a well bore, said plunger lift including at least a main channel secured to and disposed between a first and second valve, said first valve adjacent a proximal end of said plunger lift, and said second valve adjacent a distal end of said plunger lift, in which said main channel promotes fluidic flow there through of fluid contained in said casing when said plunger descends through said well bore;

closing said first valve by engaging a first sealing member to a first valve seat at a proximal end of the main channel;

closing said second valve by engaging a second sealing member engaging a second valve seat at a distal end of said main channel in response to a pressure impinging upon said distal end of said plunger lift; and accumulating pressure on said proximal end of said plunger lift to overcome said pressure on said distal end of said plunger lift thereby forcing said plunger lift to traverse a well bore and evacuate any fluids present above said plunger lift, and in which said second valve is a check valve that includes at least a side port and a central port in fluidic communication with said main channel, said second sealing member disposed within said central port and confined by said side port, said second valve seat communicating with said main channel, and a restriction bar adjacent said central port, said restriction bar precluding said second sealing member from evacuating said central port while assuring said central port remains open, wherein said second sealing member precludes fluid through said main channel when said second sealing member is in sealing engagement with said second valve seat.

2. The method of claim 1, wherein the plunger lift begins accumulating pressure after the first valve is closed in response to reaching a predetermined region of the well bore.

3. The method of claim 1, wherein the plunger lift is positioned in a well bore with the first valve open and the second valve closed, and transmission through the well bore subsequently opens the second valve.

4. The method of claim 1, wherein the first valve remains closed while the second valve opens and subsequently closes in response to a pressure in the main channel that is greater than the pressure at the distal end of the plunger lift, as said plunger lift rises through said well bore so as to equalize pressure between said main channel and said pressure at the distal end of the plunger lift.

5. The method of claim 1, wherein the plunger lift prevents the flow of fluid through the well bore when the first valve is closed.

6. The method of claim 1, wherein the plunger lift including at least the first and second valves traverse the well bore.

7. The method of claim 1, wherein the plunger lift allows fluid to flow through the main channel while descending through the well bore.

8. The method of claim 1, wherein the plunger lift traverses part of the well bore, the first valve opens, the plunger lift returns to an initial position in the well bore, and the first valve closes in response to reaches said initial position.

9. An apparatus comprising:

a plunger lift confined by a casing within a well bore, said plunger lift including at least a main channel secured to and disposed between a first and second valve, said first valve adjacent a proximal end of said plunger lift, and said second valve adjacent a distal end of said plunger lift, in which said main channel promotes fluidic flow there through of fluid contained in said casing when said plunger descends through said well bore;

a first sealing member that engages a first valve seat to close the first valve at a proximal end of the main channel;

a second sealing member that engages a second valve seat to close the second valve at a distal end of the main channel in response to a pressure impinging upon said distal end of said plunger lift so that pressure can accumulate on said proximal end of said plunger lift to overcome said pressure on said distal end of said plunger lift thereby forcing said plunger lift to traverse a well bore and evacuate any fluids present above said plunger lift, and in which said second valve is a check valve that includes at least a side port and a central port in fluidic communication with said main channel, said second sealing member disposed within said central port and confined by said side port, said second valve seat communicating with said main channel, and a restriction bar adjacent said central port, said restriction bar precluding said second sealing member from evacuating said central port while assuring said central port remains open, wherein said second sealing member precludes fluid through said main channel when said second sealing member is in sealing engagement with said second valve seat.

10. The apparatus of claim 9, wherein fluid enters the plunger lift and the main channel through a plurality of openings that surround both the first and second valves.

11. The apparatus of claim 9, wherein the first and second valves are ball valves.

12. The apparatus of claim 9, wherein the first valve is positioned in the plunger lift in an opposing orientation with respect to the second valve.

13. The apparatus of claim 9, wherein the first valve is closed with an independent pushrod that is manipulated by a compressive member.

14. The apparatus of claim 9, wherein the first valve automatically open to allow fluidic flow through the main channel when a predetermined pressure condition is met.

15. The apparatus of claim 14, wherein the predetermined pressure condition is when no pressure differential exists between a first port and a second port.

16. The apparatus of claim 9, wherein the first valve in response to a pushrod engaging a portion of the well bore.

17. The apparatus of claim 9, wherein fluid enters and exits the main channel through openings in the sides of the plunger lift at both the first and second valves.

18. The apparatus of claim 9, wherein the main channel is configured within a ribbed region of the plunger lift that has a plurality of protrusions.

19. The apparatus of claim 18, wherein the protrusions are uniform and circumferentially extend about the plunger lift.

20. The apparatus of claim 18, wherein the protrusions create a plurality of fluidic turbulences while traversing the well bore.

* * * * *